US006362844B1

(12) United States Patent
Shieh et al.

(10) Patent No.: US 6,362,844 B1
(45) **Date of Patent: *Mar. 26, 2002**

(54) STRUCTURE OF A PIEZOELECTRIC INK-JET PRINTER HEAD

(75) Inventors: Shen-Jye Shieh; Ru-Shi Liu; Ying-Jay Yang; Yu-Yang Lu, all of Taipei (TW)

(73) Assignee: Acer Peripherals, Inc. (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/956,884

(22) Filed: Oct. 23, 1997

(51) Int. Cl.[7] ..... B41J 2/045
(52) U.S. Cl. ..... 347/70
(58) Field of Search ..... 347/68–71

(56) References Cited

U.S. PATENT DOCUMENTS 4,520,374 A * 5/1985 Koto ..... 347/70
5,184,155 A * 2/1993 Yonekubo et al. ..... 347/68
5,406,318 A * 4/1995 Moore et al. ..... 347/70
5,465,108 A * 11/1995 Fujimoto ..... 347/68

* cited by examiner

*Primary Examiner*—John Barlow
*Assistant Examiner*—Charles W. Stewart, Jr.
(74) *Attorney, Agent, or Firm*—Fulbright & Jaworski L.L.P.

(57) ABSTRACT

A structure of an ink-jet printer head of a piezoelectric type comprising a deformable polymer membrane, an actuator and an ink tank is provided. The deformable polymer membrane covers the top opening of the ink tank to enclose the ink tank. The actuator, which is a double-layer piezoelectric ceramic plate, is mounted on the deformable polymer membrane with one end thereof being fixedly connected to the polymer membrane and the other end thereof being free to vibrate. As a double-layer piezoelectric ceramic plate is employed as the actuator, it includes a top and a bottom piezoelectric layers. A predetermined voltage signal is applied selectively across the upper-surface electrode and the lower-surface electrode of the top and bottom piezoelectric layer respectively such that the top piezoelectric layer extends and the bottom layer shortens selectively. The different directions of the deformation of the top and bottom piezoelectric layers, therefore, cause the desired vibration of the free end of the actuator. The vibration action of the deformable membrane causes a perturbation action to the ink inside the tank such that the ink is jetted, through the outlet, towards the outside of the printer head.

8 Claims, 3 Drawing Sheets

FIG. 1
PRIOR ART
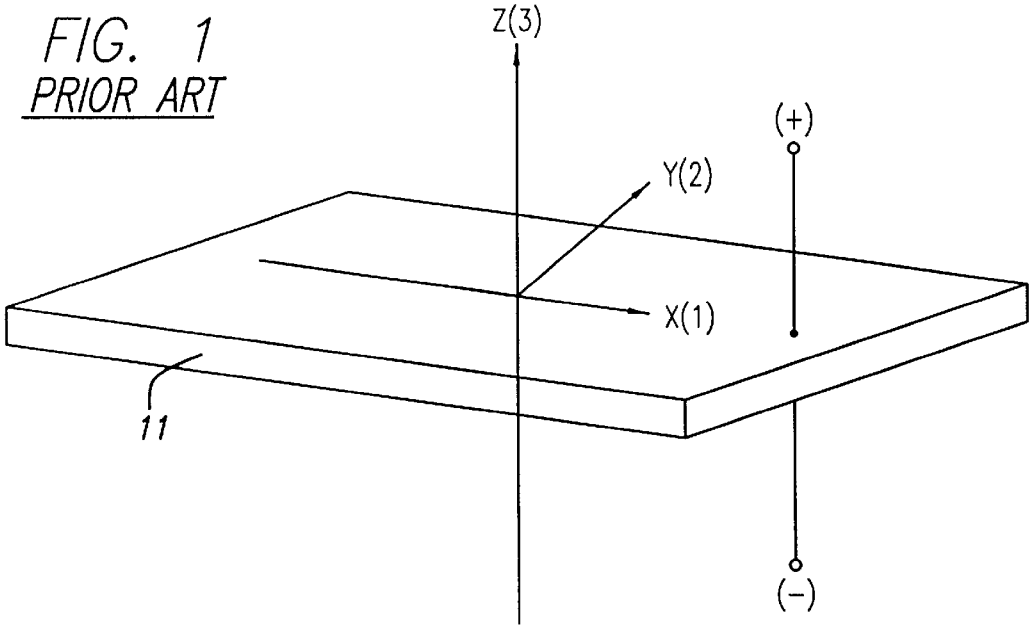
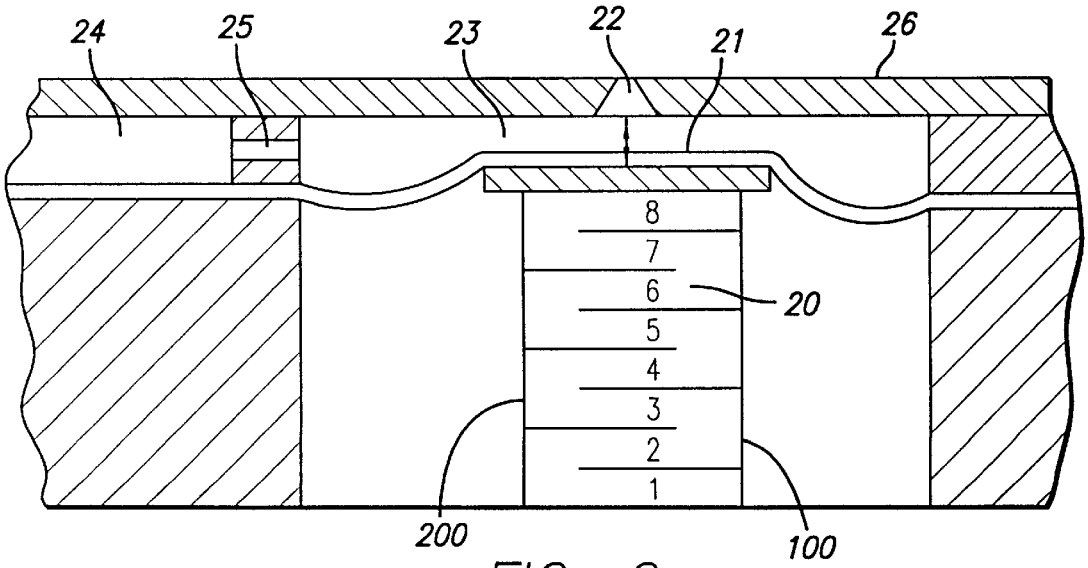
FIG. 2
PRIOR ART

STRUCTURE OF A PIEZOELECTRIC INK-JET PRINTER HEAD

FIELD OF THE INVENTION

The present invention relates to an ink-jet printer head of the piezoelectric type.

BACKGROUND OF THE INVENTION

An ink-jet printer head of the thermal-bubble type is conventionally used to jet the ink onto a medium to form an image thereon. The printer head of the type typically generates a large driving force. i.e. about 40 atmosphere pressures, onto the ink droplet being jetted. At the moment the ink droplet leaves the printer head, a droplet trailing phenomenon is observed. Therefore, ink-jet printer of the type wastes ink, and has difficulty in controlling the desired shape and size of the ink droplet. In addition, lower resolution printing quality is also the drawback with the thermal-bubble type ink-jet printer.

The piezoelectric type is another category of the ink-jet printer head which utilizes a piezoelectric ceramic plate as an actuator for driving the ink. The driving force of such type is about 4 atmosphere pressures, which is much smaller than one generated by the thermal-bubble type. Due to the characteristic of driving mechanism, the size of the ink droplet is smaller and the droplet trailing phenomenon is substantially reduced. In addition, the piezoelectric type printer head saves ink and has a higher resolution compared with the thermal-bubble ink-jet type.

The characteristics of the piezoelectric ceramic plate is introduced in the following by referencing FIG. 1. As well known in the arts, the piezoelectric ceramic plate is made with one predetermined polarization direction. For piezoelectric material whose polarization direction is $d_{31}$, the deformation of the piezoelectric material will be in X direction, when an electric field is applied in Z direction. On the other hand, for piezoelectric material whose polarization direction is $d_{33}$, the deformation of the piezoelectric material will be in Z direction, when the applied electric field is in Z direction. Two well known conventional approaches are used to operate the piezoelectric type printer head. The first one involves utilizing a multi-layer piezoelectric ceramic plate as an actuator to jet the ink as shown in FIG. 2. Referring to FIG. 2, the multi-layer, i.e. 8 layers, piezoelectric ceramic plate 20 is disposed in a housing with the bottom end fixed and the upper end free to move. The polarization direction of each layer of the piezoelectric ceramic plate 20 is $d_{33}$. The positive electrodes for each layer within the multi-layer ceramic plate 20 together form a comb configuration denoted as 100. The negative electrodes for each layer within the multi-layer ceramic plate 20 together form a comb configuration denoted as 200.

Initially when a first voltage is applied across the positive and negative electrodes, the electric field generated will make each layer deform and cause the multi-layer piezoelectric plate 20 to move downwards. The rubber pad 21 moves downwards accordingly. The space of the ink tank 23 becomes larger and the ink flows from the ink container 24 into the ink tank 23 via the passage 25. Afterwards when a second voltage is applied across the positive and negative electrodes, the direction of the electric field generated will be opposite, and each layer deforms in the opposite direction and causes the multi-layer piezoelectric plate 20 to move upwards. The rubber pad 21 moves upwards accordingly. The ink tank 23 will become smaller, and the pressure inside the ink tank 23 will force the ink to be jetted from the ink tank 23 via the outlet 22.

In the structure of FIG. 2, the multi-layer piezoelectric ceramic plate 20 is positioned under the outlet 22 with the upper end moves in a vertical direction. The amount of the displacement $\Delta X$ of the upper end of the multi-layer piezoelectric ceramic plate 20 is calculated by the following equation: $\Delta X = d_{33} * V * n$, wherein $d_{33}$ is the piezoelectric parameter, V is the voltage applied across two electrodes, and n is the number of the layers within the multi-layer piezoelectric ceramic plate 20. Due to its multi-layer structure, the multi-layer piezoelectric ceramic plate in FIG. 2 has a larger displacement when applied with a voltage, and results in a larger driving force to the ink. However, the manufacturing of multi-layer piezoelectric ceramic plate 20 and the electrodes is difficult and costly.

The second approach performs the function through another way. The walls of the ink tank are formed by piezoelectric ceramic segments. When the walls of the ink tank are applied with a voltage, the shape of the ink tank will be changed and thus the ink will be jetted out of the ink tank. FIG. 3*a* shows a cross-sectional view of the structure in which the side walls of the ink tank 302 deforms in response to the voltage applied across the corresponding electrodes. The shown cross section is perpendicular to the longitudinal dimension (into the paper) of the ink tanks 301, 302, 303. The structure includes a plurality of single-layer piezoelectric ceramic segments 321, 322, 323, 324 which are formed by a diamond cutting process on a single sheet of piezoelectric ceramic plate. After the cutting procedure, corresponding side walls of two successive piezoelectric ceramic segments, i.e. 322, 323, constitute one ink tank 302 therebetween. The electrodes 39 on the inner surface of each ink tank are respectively formed by an electrodeless nickel plating process. A sheet of glass or ceramic plate 34 is covered and connected onto the upper surface of the piezoelectric ceramic segments to totally enclose the tank space. Two voltages A, B shown in FIG. 3(*b*) are applied across the respective electrodes to create corresponding deformation as desired. As a result, the right side wall of the tank 302 deforms rightwards and the left side wall of the tank 302 deforms leftwards. Therefore, the size of the ink tank 302 increases due to the deformation. The space of the ink tanks 302 increases, and the ink will be drawn from an ink container (not shown) into the ink tank 302. Afterwards, the voltage A drops sharply to a negative value and the voltage B elevates sharply to a positive value. Due to this opposite action, the dimension of the tank 302 decreases due to the deformation of the piezoelectric ceramic segments 322, 323 in a reverse direction. As the space of the ink tank 302 decreases, the ink is jetted from the ink tank 302 via an outlet 31. The plastic substrate 38 is made of soft and resilient material which also helps the ink tank 302 generate the driving force. Since the electrodeless plating process is used to manufacture the electrodes 39, its endurance against the ink erosion is enhanced. However, this second approach of the piezoelectric type printer head is complex in structure and in manufacturing. More details regarding the second approach disclosed in FIG. 3(*a*) can be found in U.S. Pat. No. 5,327,627.

SUMMARY OF THE PRESENT INVENTION

The main object of the present invention is to provide a ink-jet printer head of the piezoelectric ceramic type which has a simple structure and is easy to manufacture.

In the present invention, the printer head includes a deformable polymer membrane, an ink tank and a dual-layer piezoelectric ceramic plate. The dual-layer piezoelectric ceramic plate is mounted on the deformable polymer membrane which functions to apply a perturbation force to the ink within the ink tank. The dual-layer of the piezoelectric ceramic plate includes an top layer and a bottom layer, both of which have same polarization direction. One end of the piezoelectric ceramic plate is fixed to the membrane and the other end is free to vibrate. When a voltage is applied across two electrodes at the fixed end of the dual-layer piezoelectric ceramic plate, the free end of the dual-layer piezoelectric ceramic plate vibrates. Through the deformable membrane, a perturbation force is created and drives the ink to be jetted outside the ink tank via an outlet.

BRIEF DESCRIPTION OF THE DRAWINGS

The various features and advantages of the present invention will be readily understood with reference to the following detailed descriptions taken in conjunction with the accompanying drawings, in which:

FIG. 1 shows the relationship between the polarization direction of a piezoelectric ceramic plate and the direction of the corresponding deformation;

FIG. 2 shows a conventional printer head which utilizes a multi-layer ceramic piezoelectric plate as an actuator;

FIG. 3(*b*) shows the voltage applied across the electrodes when operating the actuator shown in FIG. 3(*a*);

FIG. 4(*b*) shows a side view of a piezoelectric ceramic printer head, in a operating state, according to the present invention.

DETAILED DESCRIPTION OF THE PRESENT INVENTION

Figure 3A:
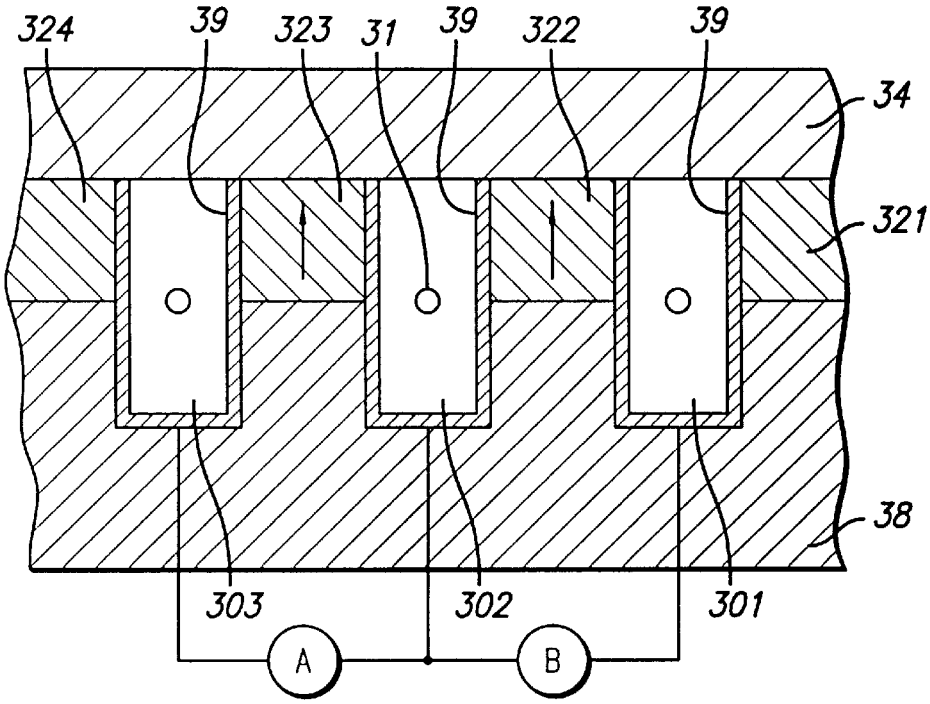
FIG. 3a PRIOR ART
FIG. 3(*a*) show another conventional printer head which utilizes a single-layer ceramic piezoelectric plate as an actuator.
Figure 3B:
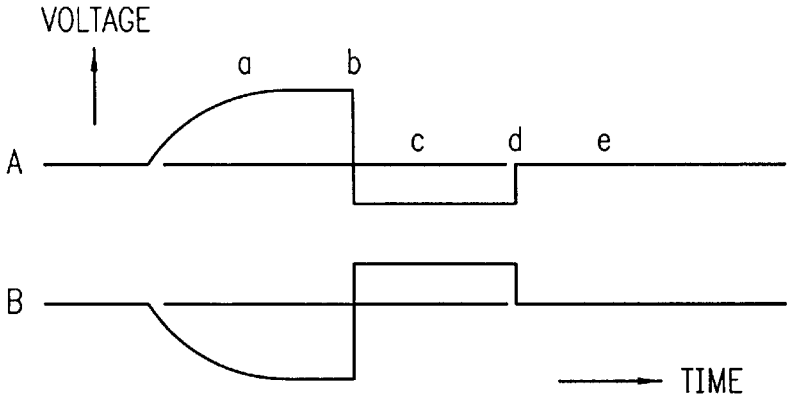
FIG. 3b PRIOR ART
Figure 4A:
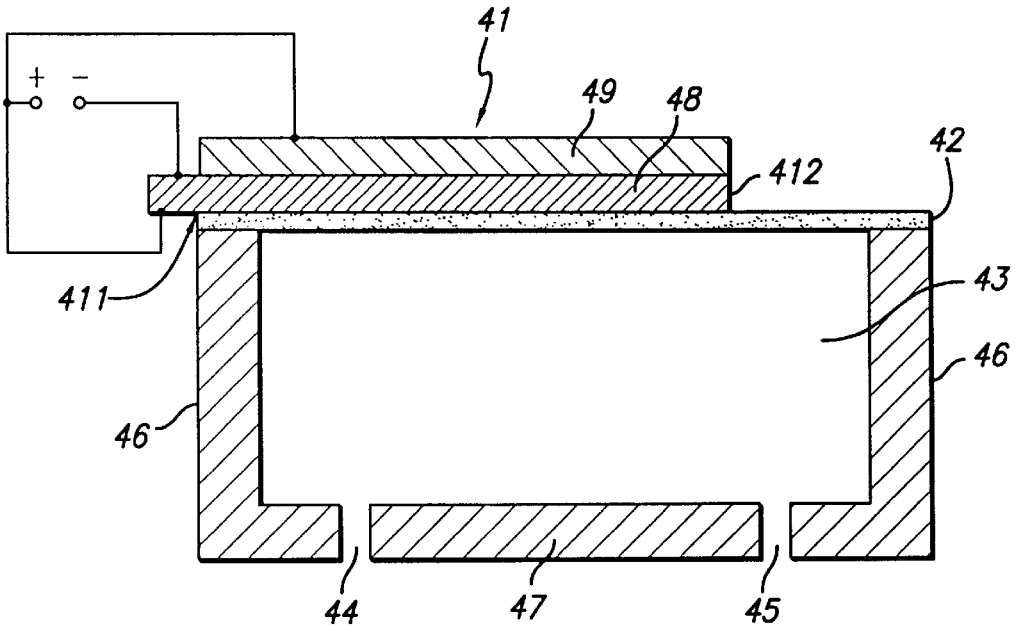
FIG. 4(*a*) shows a side view of a piezoelectric ceramic printer head, in a neutral state, according to the present invention.
Figure 4B:
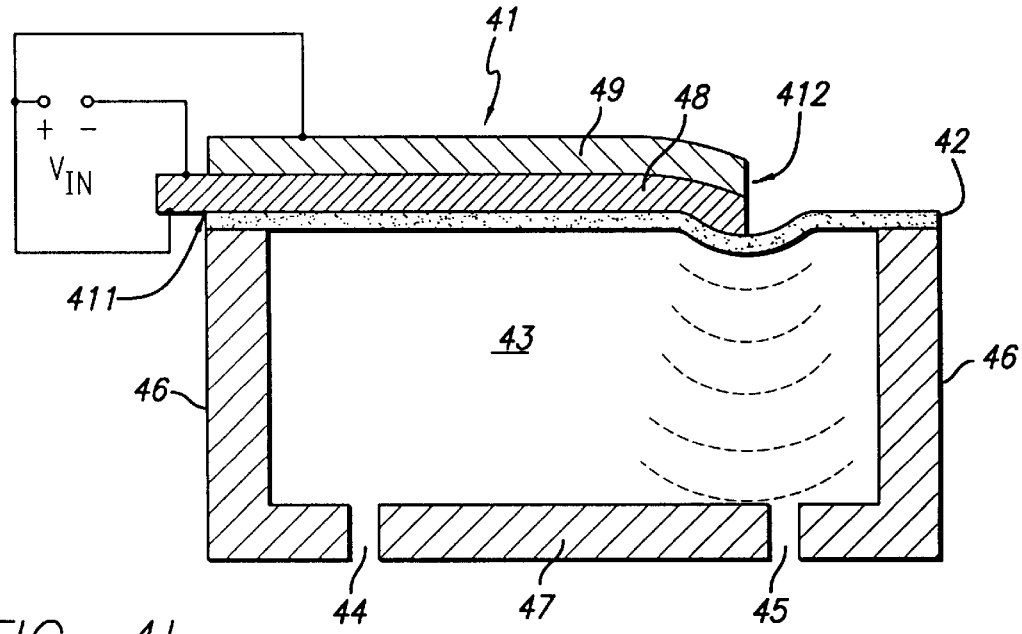

FIG. 4(*a*) shows a structure of a piezoelectric ceramic printer head according to the embodiment of the present invention. The printer head includes a double-layer piezoelectric ceramic plate 41, a deformable polymer membrane 42 and an ink tank 43. The ceramic plate 41 has a piezoelectric parameter ($d_{31}$) about $-215*10^{-12}$ m/V. The deformable polymer membrane 42 is made of, for example, the polyester or polyimide. The ink tank 43 which is made of ceramic materials, such as zirconium oxide or aluminum oxide. The ink tank 43 is formed by a bottom plane 47, side walls 46, an ink inlet 44 and an ink outlet 45. The deformable polymer membrane 42 functions as the top cover of the ink tank 43 and connects to the top surfaces of the side walls 46. The deformable polymer membrane 42, side walls 46, bottom plane 47 together form the enclosure which stores the ink. The double-layer piezoelectric ceramic plate 41 consists of two stacked piezoelectric layers of same polarization directions. The piezoelectric ceramic plate 41 is mounted on the deformable polymer membrane 42 and functions as an actuator for actuating the membrane 42. The piezoelectric ceramic plate 41 is mounted on the membrane 42 with one end 411 fixedly connected to the membrane 42 and the other end 412 is free to vibrate. As shown, the length of the double-layer piezoelectric ceramic plate 41 is shorter than that of the membrane 42.

In a preferred embodiment, the ink outlet 45 is disposed at a horizontal location which substantially corresponds with the location of the free end 412 of the piezoelectric ceramic plate 41.

According to the embodiment, the dual-layer piezoelectric ceramic plate 41 consists of a top layer 49 and a bottom layer 48, both of which have a same polarization direction. The top layer 49 and the bottom layer 48 are equipped with electrodes respectively as shown in FIG. 4(*a*), and wherein the upper electrode of the top layer 49 and the bottom electrode of the bottom layer 48 are connected to the positive terminal of the voltage supply, the lower electrode of the top layer 49 and the top electrode of the bottom layer 48 are connected to the negative terminal of the voltage supply. When the electrodes of top and bottom layers 49 and 48 are free of voltage supply, they assume their initial states shown in FIG. 4(*a*). When the voltage Vin is applied across the electrodes, the top layer 49 stretches and the bottom layer 48 shortens. These two different actions cause the dual-layer piezoelectric plate 41 to bend downwards. The deflection of the dual-layer piezoelectric ceramic plate 41 depends on its thickness and the distance from the fixed end 411 to the free end 412. This amount of deflection z is calculated by $z=9*10^{-10}$ ($L^2/h^2$) meter/Volt, h is the thickness of the piezoelectric ceramic plate, L is the distance from the fixed end 411 to the free end 412.

Referring to FIG. 4(*b*), as the piezoelectric ceramic plate 41 bends downwards, the deformable polymer membrane 42 is forced to move downwards accordingly. As the applied voltage is removed and as the piezoelectric ceramic plate 41 returns to its initial undeformed state, the deformable polymer membrane 42 also returns to its initial state shown in FIG. 4(*a*). As the voltage is applied and removed in very high frequency, the deformable polymer membrane 42 vibrates accordingly in a corresponding frequency. This high frequency vibration action of the deformable polymer membrane 42 generates a perturbation action to the ink within the ink tank. The perturbation action therefore jet the ink out of the ink tank 43 via the ink outlet 45. The manufacturing process of such piezoelectric ceramic jet printer head may be summarized as the following steps.

1) Manufacturing the ink tank 43 formed of a bottom plane and side walls with ink inlet and ink outlet.

2) A deformable membrane 42 is covered over the top opening of the ink tank 43 to form an enclosure for storing the ink.

3) Manufacturing a dual-layer piezoelectric ceramic plate 41 which includes an top layer and a bottom layer. The top and bottom layers have same polarization direction. Two electrodes are respectively provided on the upper and lower surfaces of the top layer and the bottom layer.

4) Mounting the dual-layer piezoelectric ceramic plate 41 onto the deformable membrane 42 with one end fixed to the membrane 42 and the other end free to vibrate.

What is claimed is:

1. An ink-jet printer head of a piezoelectric ceramic type, comprising:

an ink tank for storing an ink therein, the ink tank having a plurality of side walls, a bottom plane, an opening and an ink outlet, the plurality of side walls defining a top edge, the opening has a first dimension in a first direction;

a deformable layer for covering the opening of the ink tank, said deformable layer having an edge attaching the top edge of the plurality of side walls; and an actuator causing the deformable layer to vibrate, the actuator being made of piezoelectric material, the actuator having a first end and a second end, a distance between the first end and the second end of the actuator being substantially shorter than the first dimension, the first end of the actuator being fixed mounted on a portion of said edge of said deformable layer, and the second end of the actuator being free to vibrate;

wherein a portion of said deformable layer between the second end of the actuator and the top edge is free of contact with both the actuator and the top edge;

wherein the vibration action of the deformable layer causes a perturbation action to the ink inside the tank such that the ink is jetted, through the outlet, towards the outside of the printer head.

2. The printer head as claimed in claim 1, wherein the deformable membrane is a polymer membrane.

3. The printer head as claimed in claim 1, wherein the actuator is a double-layer piezoelectric ceramic plate.

4. The printer head as claimed in claim 3, wherein the double-layer piezoelectric ceramic plate comprises a top and a bottom piezoelectric layer both of which have a same polarization direction, wherein the top piezoelectric layer and the bottom piezoelectric layer respectively includes an upper-surface electrode and a lower-surface electrode, a predetermined voltage signal is applied selectively across the upper-surface electrode and the lower-surface electrode of the top and bottom piezoelectric layer respectively such that the top piezoelectric layer extends and the bottom layer shortens selectively.

5. The printer head as claimed in claim 1, wherein the ink outlet is formed on the bottom plane of said ink tank at a location substantially corresponding to the second end of the actuator.

6. An ink-jet printer head of a piezoelectric ceramic type, comprising:

an ink tank for storing an ink therein, the ink tank having a plurality of side walls, a bottom plane, an opening and an ink outlet, the plurality of side walls defining a top edge, the opening has a first dimension in a first direction;

a deformable layer for covering the opening of the ink tank, said deformable layer having an edge attaching the top edge of the plurality of side walls; and an actuator having a top layer and a bottom layer for causing the deformable layer to vibrate, the actuator being made of piezoelectric material, the actuator having a first end and a second end, a distance between the first end and the second end of the actuator being substantially shorter than the first dimension, the first end of the actuator being fixed mounted on a portion of said edge of said deformable layer, and the second end of the actuator being free to vibrate;

wherein when a voltage is applied on the actuator, the top layer stretches and the bottom layer shortens to cause a deflection of the actuator, the deflection of the actuator depending on a thickness of the actuator and the distance between the first end and the second end of the actuator;

wherein the vibration action of the deformable layer causes a perturbation action to the ink inside the tank such that the ink is jetted, through the outlet, towards the outside of the printer head.

7. An ink-jet printer head of a piezoelectric ceramic type, comprising:

an ink tank for storing an ink therein, the ink tank having a plurality of side walls, a bottom plane, an opening and an ink outlet, the plurality of side walls defining a top edge, the opening has a first dimension in a first direction;

a deformable layer for covering the opening of the ink tank, said deformable layer having an edge attaching the top edge of the plurality of side walls; and an actuator causing the deformable layer to vibrate, the actuator being made of piezoelectric material, the actuator having a first end and a second end, a distance between the first end and the second end of the actuator being substantially shorter than the first dimension, the first end of the actuator being fixed mounted on a portion of said edge of said deformable layer, and the second end of the actuator being free to vibrate;

wherein the ink outlet is disposed at a location in the first direction which corresponds with the location of the first end of the actuator;

wherein the vibration action of the deformable layer causes a perturbation action to the ink inside the tank such that the ink is jetted, through the outlet, towards the outside of the printer head.

8. An ink-jet printer head of a piezoelectric ceramic type, comprising:

an ink tank for storing an ink therein, the ink tank having a plurality of side walls, a bottom plane, an opening and an ink outlet, the plurality of side walls defining a top edge, the opening has a first dimension in a first direction;

a deformable layer for covering the opening of the ink tank, said deformable layer having an edge attaching the top edge of the plurality of side walls; and an actuator causing the deformable layer to vibrate, the actuator being made of piezoelectric material, the actuator having a first end and a second end, a distance between the first end and the second end of the actuator being substantially shorter than the first dimension, the first end of the actuator being fixed mounted on a portion of said edge of said deformable layer, and the second end of the actuator being free to vibrate;

wherein a length of the actuator is shorter than a length of the deformable layer;

wherein the vibration action of the deformable layer causes a perturbation action to the ink inside the tank such that the ink is jetted, through the outlet, towards the outside of the printer head.

* * * * *